US008413849B2

(12) United States Patent
Flores

(10) Patent No.: US 8,413,849 B2
(45) Date of Patent: Apr. 9, 2013

(54) SECURE DISPENSING SYSTEM FOR MULTIPLE CONSUMABLES

(76) Inventor: Miriam M Flores, Lymwood, CA (US)

( * ) Notice: Subject to any disclaimer, the term of this patent is extended or adjusted under 35 U.S.C. 154(b) by 373 days.

(21) Appl. No.: 12/821,246

(22) Filed: Jun. 23, 2010

(65) Prior Publication Data

US 2011/0036867 A1 Feb. 17, 2011

Related U.S. Application Data

(60) Provisional application No. 61/233,140, filed on Aug. 12, 2009.

(51) Int. Cl.
*B67D 7/06* (2010.01)

(52) U.S. Cl.
USPC ..... 222/153.13; 222/135

(58) Field of Classification Search ..... 222/135, 222/153.13, 402.11, 144.5
See application file for complete search history.

(56) References Cited

U.S. PATENT DOCUMENTS 3,269,605 A * 8/1966 Silver ..... 222/135
4,711,375 A * 12/1987 Mader et al. ..... 222/135
4,902,281 A * 2/1990 Avoy ..... 604/191
5,005,736 A * 4/1991 Portas ..... 222/135
5,740,947 A * 4/1998 Flaig et al. ..... 222/135
6,968,982 B1 * 11/2005 Burns ..... 222/321.7
7,654,415 B2 * 2/2010 van der Heijden ..... 222/135
7,686,191 B1 * 3/2010 Burns ..... 222/182
7,793,799 B2 * 9/2010 Reggiani ..... 222/135
7,946,452 B2 * 5/2011 Hantman et al. ..... 222/94
2004/0149775 A1 * 8/2004 Chen ..... 222/135
2010/0147878 A1 * 6/2010 Ligny ..... 222/23

* cited by examiner

*Primary Examiner* — Kevin P Shaver
*Assistant Examiner* — Donnell Long
(74) *Attorney, Agent, or Firm* — Geeta Kadambi; Riddhi IP LLC

(57) ABSTRACT

A security tab isolating varied dispensing apertures with a multi chamber consumable container is disclosed. In one embodiment the dispensing apertures are similar and have either a spray dispenser or a spot dispenser. In another embodiment they may have dissimilar apertures such as a spray dispenser and a spout dispenser. The dispensing aperture can be operated simultaneously or separately. The dispensing aperture may be sealed individually or together with a security tab. The sealing of the dispensing apertures with a security tab enables the user to select the consumable of choice, to prevent loss and accidental usage of the wrong consumable.

20 Claims, 14 Drawing Sheets

SECURE DISPENSING SYSTEM FOR MULTIPLE CONSUMABLES

CLAIM OF PRIORITY

The present Application claims the priority of U.S. Provisional Patent Application No. 61/233,140, entitled "Secure dispensing system for multiple consumables," by Miriam M. Flores, filed Aug. 12, 2009, and is incorporated by reference herein in its entirety.

FIELD OF TECHNOLOGY

This disclosure relates generally to the field of a secure dispensing system for several types of consumables. The secure dispensing system, when secured to a chambered bottle containing the consumables is convenient to carry, use, quickly open and close, refill with ease and has an elegant and beautiful appearance.

BACKGROUND

Generally, a person has to carry two different types of containers for different consumables such as a perfume and a face cream, tooth paste and a mouth wash, shaving cream and after shave lotion, diaper rash cream and baby cream, hair spray and mousse, shampoo and conditioner, sun screen and moisturizer cream, disinfectant anti-bacterial and soap, hand sanitizer and hand lotion and a water and a drink etc.

The containers may be large and may not be convenient to carry such as in carry on luggage or a ladies purse. New security systems prohibit carrying bulky liquid containers. It also makes it bulky to carry when one is travelling and/or going to remote locations where certain necessary consumables may not be available.

SUMMARY

In one embodiment a secure dispensing system is disclosed. The dispensing system has more than one dispenser. The dispensers are separated by a unique security tab that prevents the dispensers to be suppressed accidentally. The security tab prevents the other dispenser to be pressed while using the first dispenser.

The security tab can be screwed in, snapped on or attached by sliding on and the dispenser heads for a particular container can be interchanged based on the requirement. The security tab may be in the form of a lid on top of the dispensers.

In one embodiment the dispenser may be placed at 90° and/or 180° or 240° angles from each other. In another embodiment they can be parallel to each other. In one embodiment they can be facing the same direction or they can be at opposite directions.

In an embodiment a dual dispenser container including a segmented container carrying different consumables is disclosed. The segmented container enables the user to dispense the consumable of choice either separately or simultaneously at a specific instance. This would also prevent unnecessary discharge of one consumable when the other is being used.

In one aspect, a single container having a separated segment and dual dispenser is disclosed. In another aspect, a container having two different consumables that are immiscible are separated in a segmented container and have their individual dispensing apertures. One aperture may be a spray aperture and the other could be a spout aperture. The top of the container would have a rigid lid partially covering the two apertures so that when one type of dispenser top is used, the other is not accidentally suppressed and consumable is not discharged.

A container may have two spray apertures for dispensing two aerosol liquids such as a perfume and an Eu de toilette or Eu de cologne. The security tab covering both the apertures may be a screw tight or press shut type and can be round shape, t-shaped or square shaped. This would prevent accidental spillage of the consumables from the container.

A container may have two spout apertures to dispense consumables such as a diaper rash cream and a baby cream. The apertures may be opened and closed individually so that a person can operate one aperture at a time instead of both. The container would be suitably labeled outside so that a distinction could easily be made for the intended purpose and the suitable consumable for a particular instance.

The container may contain a pivoting lid so that one aperture at a time can be opened. The pivoting lid would close one of the apertures so an individual can use one consumable at a time.

A container may have a combination of apertures such as a spray dispenser and a spout dispenser to store a combination of consumables such as a tooth paste and a mouth wash, a perfume and a hand lotion, shaving cream and after shave lotion, diaper rash cream and baby cream, hair spray and mousse, shampoo and conditioner, sun screen and moisturizer cream, disinfectant anti-bacterial and soap, hand sanitizer and hand lotion, a water and a drink etc.

A container may have rigid separated segments for two different consumables. The container may also have a replaceable and disposable sub-segment that can be inserted once a particular consumable has been used up. The container itself may be reusable or disposable.

The apertures may be designed as a lid that are detachable from one container and fit into another container of similar size. The container is portable and suitable for personal use. The container is suitable for carry-on luggage, personal luggage and remote area usage such as camping.

Other features will be apparent from the accompanying drawings and from the detailed description that follows.

BRIEF DESCRIPTION OF THE DRAWINGS

Example embodiments are illustrated by way of example and not limitation in the figures of the accompanying drawings, in which like references indicate similar elements and in which:

FIG. 9 B illustrates a view of a cylindrical two dispenser container with two spray apertures.

Other features of the present embodiments will be apparent from the accompanying drawings and from the detailed description that follows.

DETAILED DESCRIPTION

A secure dispensing system is described. Although the present embodiments have been described with reference to specific example embodiments, it will be evident that various modifications and changes may be made to these embodiments without departing from the broader spirit and scope of the various embodiments.

Figure 1:
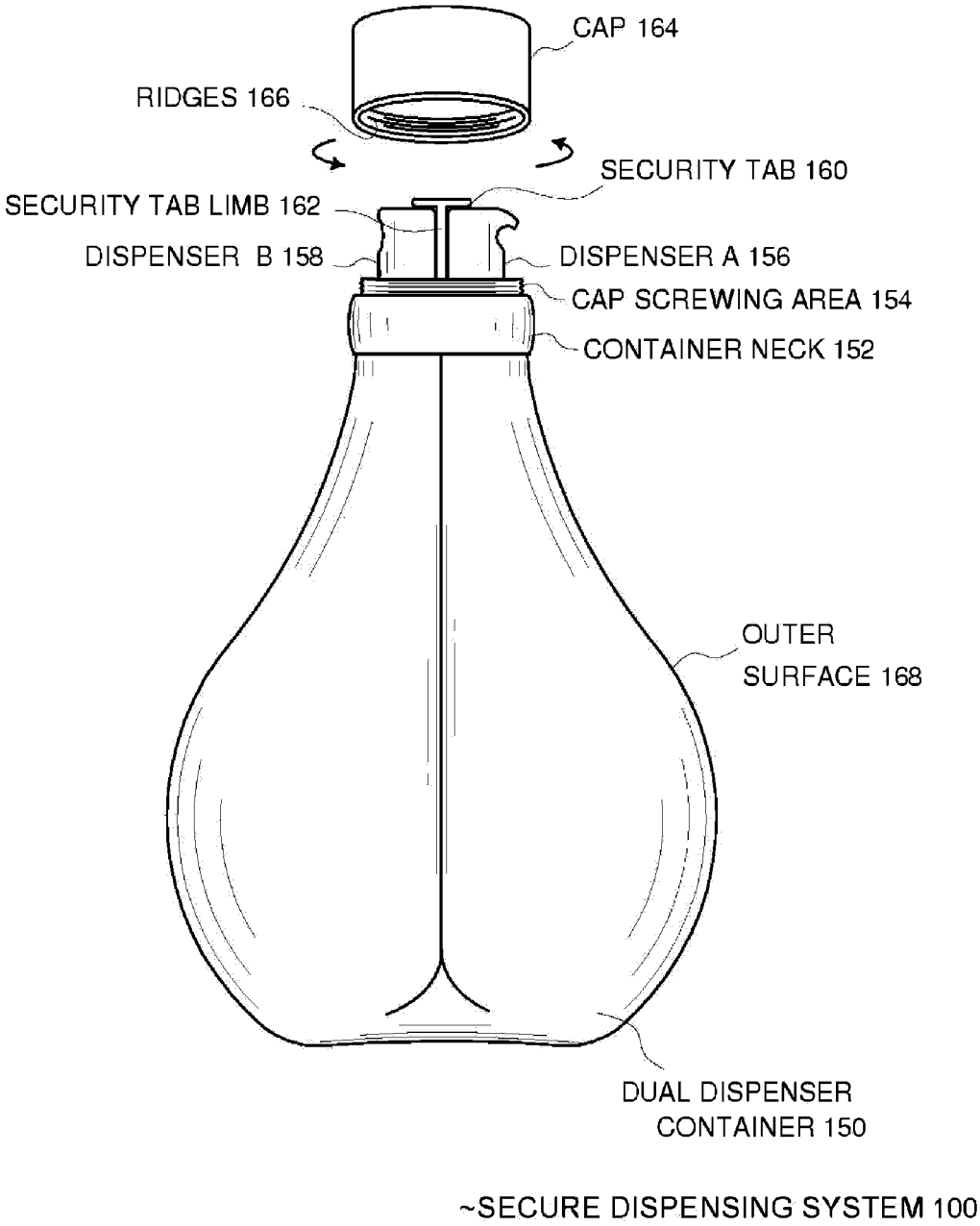
FIG. 1 illustrates an exterior view of a secure dispensing system, according to one embodiment.

FIG. 1 illustrates an exterior view of a secure dispensing system 100, according to one embodiment. In one embodiment, FIG. 1 illustrates a dual dispenser container 150 and outer surface 168 that can hold two dispenser containers. The dual dispenser container 150 may be provided with a cap 164. The cap 164 may include ridges 166 that may allow the cap 164 to fit properly to the neck of the container over cap screwing area 154. The security tab 160 and security tab limb 162 may be placed in between the dispenser tabs, so that fortuitously one cannot press both together.

The dual dispenser container 150 may include two dispenser containers to store different consumables in each container. The consumables in each dispenser container may be dispensed through the nozzles while maintaining a consistent and aesthetically pleasing appearance at the time of usage of the consumables.

The apertures of the nozzle may be enclosed by the cap 164 so that the accidental spilling of the consumables in the containers may be avoided. For example, the contents may not spill out when the dual dispenser container 150 is placed inclined in the hand baggage or suitcase during traveling. Any type of cap that can fit to the nozzle may be used. For example, the cap 164 may be a screw on cap, a twist cap, a snap shut cap, a pull-off cap, etc. The cap 164 may also be a flip-open top for a convenient consumer use.

The dispenser containers may contain consumables of same viscosity or different viscosities and the contents in the containers may be dispensed separately. The dispenser containers may include a spray dispenser and/or a spout type dispenser (e.g., a dispenser A 156 or a dispenser B 158 as illustrated in FIG. 1). The containers may be replaceable and/or reusable. The nozzle may be of any configuration, such as, a pin hole tip, slit, atomizer, or the like to suit the spray and/or spout mechanism. The internal containers and outer bottle may be of any form or pattern to suit the dispensing application at hand.

The dimension of the apertures in the nozzle may be determined based on the viscosity and rheology of the contents to be filled in the dispenser containers of the dual dispenser container 150. A smaller dimension is chosen for the apertures when the content has a lower viscosity and a larger dimension is chosen for the aperture when the content has a higher viscosity.

The dual dispenser container 150 may provide easy storage and distribution of the consumables. In addition, the dual dispenser container 150 may be molded to any convenient shape and size. The dual dispenser container may be made of at least one of glass, thermoplastic material, biodegradable material and plastic. The container pouches may be available in the market along with the contents or may be filled by the user In an example embodiment, the dispenser containers may be used to store cosmetic consumable product (e.g., body lotion, perfumes, shampoo, conditioners, hair spray, etc.), hygienic consumable product (e.g., disinfectant solutions, cleansing gels etc.), paint consumable product (e.g., paint, solvent, etc.), medicinal consumable product (e.g., mouth wash, pain relief creams/gels, bug repellents, anti-allergic solutions or creams etc.), drinking consumable product (e.g., water, juices, soft drinks, soda water etc.), and any other similar products.

In another embodiment, the dual dispenser container 150 and the dispenser containers inside it may be made up of transparent material or a translucent material that may allow a user to see through the contents of the containers. The dual dispenser container 150 may be durable and safe to use.

Figure 2:
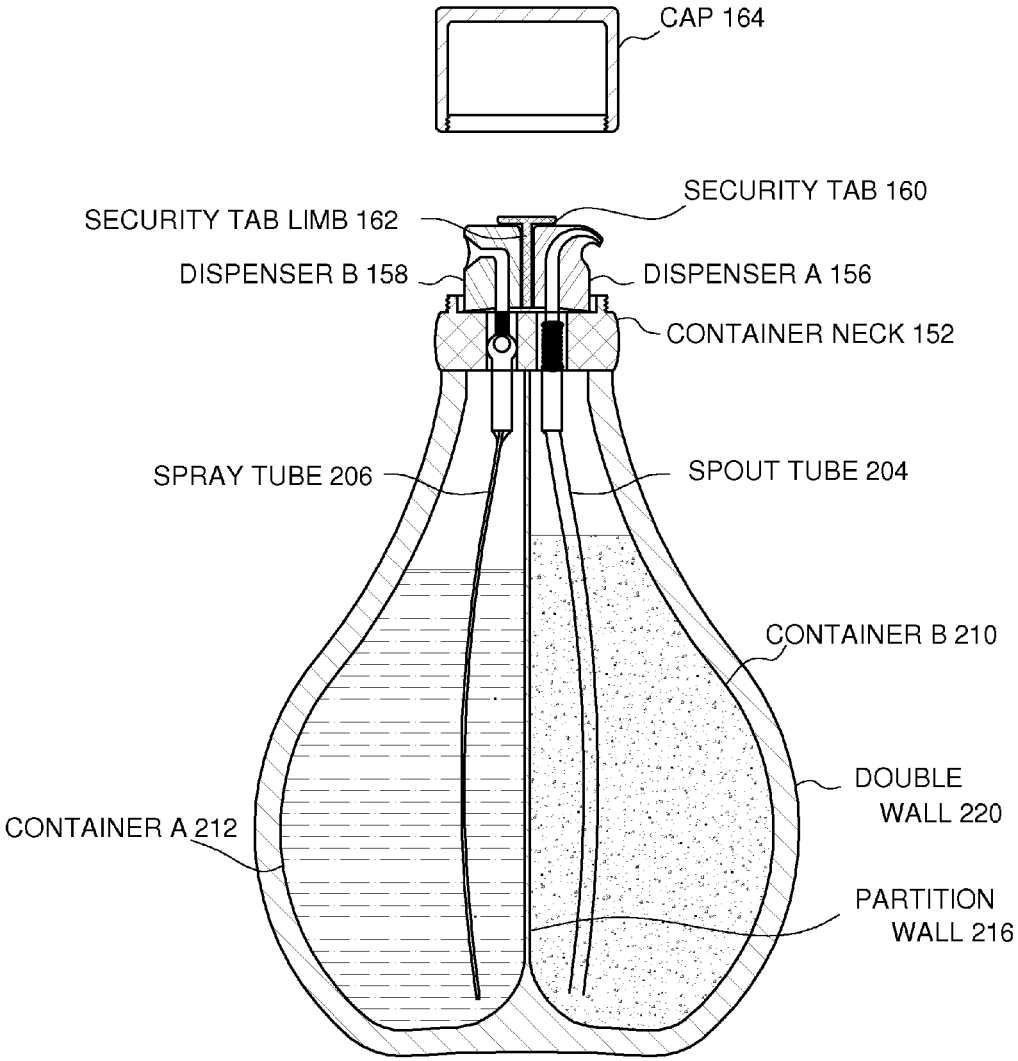
FIG. 2 illustrates a cross sectional view of the dual dispenser container illustrated in FIG. 1, according to another embodiment.

FIG. 2 illustrates a cross sectional view of the dual dispenser container illustrated in FIG. 1, according to another embodiment.

In an embodiment, the dual dispenser container 150 may be provided with effective containers for storing and dispensing different consumables that are frequently used at the same time or uninterruptedly used one after the other. The containers may include different types of consumables of various viscosities that are packaged for dispensing by a user either individually or collectively as the user requires. The dual dispenser container 150 may have a thick double wall 220 to protect the containers (e.g., pouches) enclosed inside it.

In an example embodiment, the dual dispenser container 150 may include a container A 212 and a container B 210 to store different consumables separately. The containers may be provided with a partition wall 216 as illustrated in FIG. 2. The dispensing nozzle may be placed on the container neck 152 as illustrated in the FIG. 2. The container A 212 and the container B 210 may be of the same size or different size and may be made up of any material that may not react with the contents of the container. For example, the containers may be made up of a suitable material that may include low density polyethylene, high density polyethylene, foils (e.g., aluminum foil) etc. The container A 212, the container B 210, and/or dual dispenser container 150 may be made up of polyethylene, polypropylene terpthalate, polyvinyl chloride (PVC), copolymers, and/or co-extrusions.

Each container may have a tube (e.g., duct) through which the consumable fluid of the container may dispense through the nozzle. The container A 212 may be provided with a spray tube 206 and the container B 210 may be provided with a spot tube.

Figure 3:
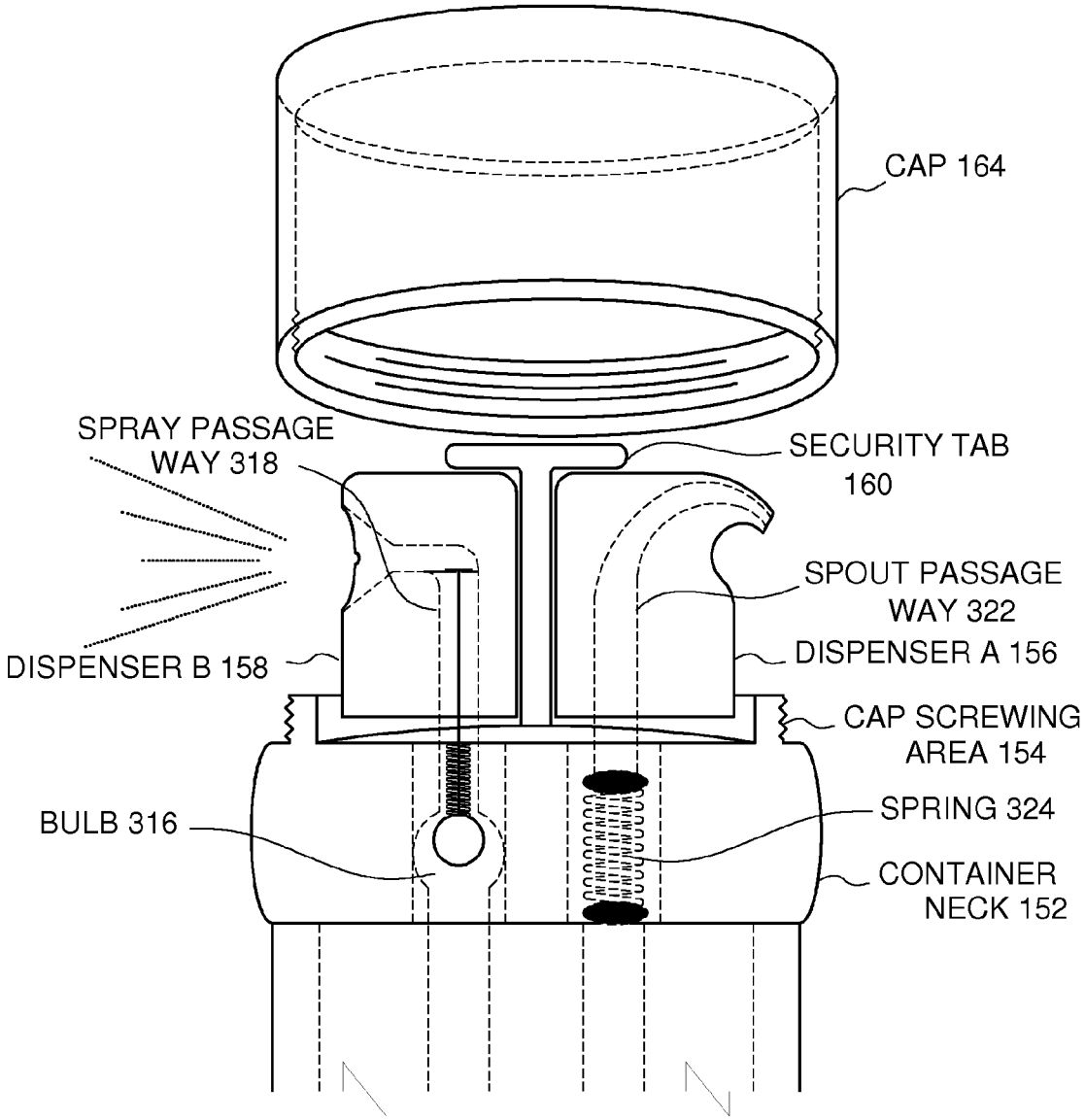
FIG. 3 illustrates a structural view of a nozzle of a dual dispenser container, according to one embodiment.

FIG. 3 illustrates a structural view of a nozzle of a dual dispenser container, according to one embodiment.

According to one embodiment, the dispensers may include a passageway linking to the respective containers. For example, the dispenser B 158 may include the spray passage way 318 and the dispenser A 156 may include the spout passageway 322. When the spot dispenser tab is pressed, a spring 324 attached to the spout passageway 322 may be compressed and the consumable may be sucked from the container through the spout tube 204 attached to the nozzle and cause the consumable in the container to spout through the aperture of the nozzle. In another embodiment, when the spray dispenser tab is pressed, a spring attached to the spray passageway 318 at the container neck may be compressed. This may change the pressure inside the spray tube 206 attached to the dispenser nozzle and cause the consumable to be pulled up the tube, past bulb 316, swiftly and sprayed out through the aperture of the dispenser B 158.

The spray dispenser may be used to dispense the consumables such as perfumes, mouth wash, disinfectants etc. The spout type of dispenser may be used to squirt the consumables such as body lotion, hand lotion, shampoo, shaving cream, etc. The nozzle of the may be closed with the cap 164 to avoid spilling of the contents of the containers.

The security tab 160 may be placed in between the dispenser tabs, so that fortuitously one cannot press both together. The security tab 160 may be made of hard and solid material so that it will not break easily when pressed. The passageways on the top of the nozzle are deflected in an opposite direction so that the two liquids do not mix.

Figure 4:
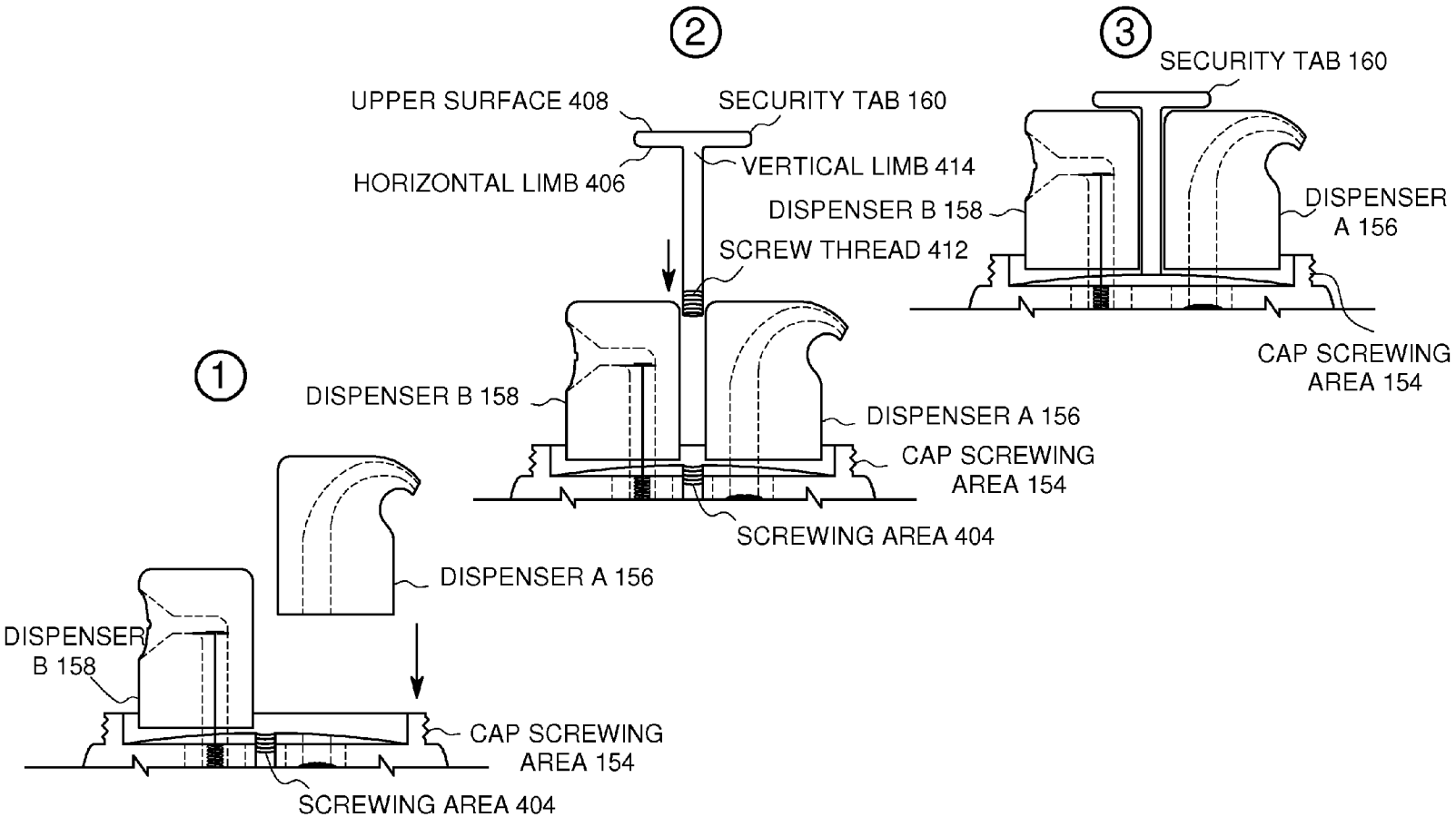
FIG. 4 illustrates assembling of the dual dispenser nozzles, according to one embodiment.

FIG. 4 illustrates assembling of the dual dispenser nozzles, according to one embodiment.

According to one embodiment, the different types of dispensers (e.g., spray dispenser, and/or spout dispenser) may be fitted depending on the consumable filled in the containers. In step 1, the dispenser B 158 may be fitted to the neck of the container. Screwing area 404 may be provided to fix the security tab 160 firmly between the dispenser A 156 and the dispenser B 158.

In another embodiment, the dispenser A 156 may be fitted to the neck of the container as illustrated in step 2. The security tab 160 may be placed between the dispenser A 158 and the dispenser A 156. The security tab 160 may be in a 'T' shape. A vertical limb 414 of the security tab 160 may be placed in between the dispenser B 158 and the dispenser A 156. A horizontal limb 406 of the security tab 160 may be placed on the top surface of the two dispensers (e.g., the dispenser A 156 and the dispenser B 158). The security tab 160 may be provided with a screw thread 412 at the end of the vertical limb 414, to fix the tab firmly in the screwing area 404. The security tab 160 may be rigid and do not bend when its upper surface 408 is pressed. In yet another embodiment, step 3 illustrates the security tab fitted between the dispenser tabs as illustrated in FIG. 4.

Figure 5:
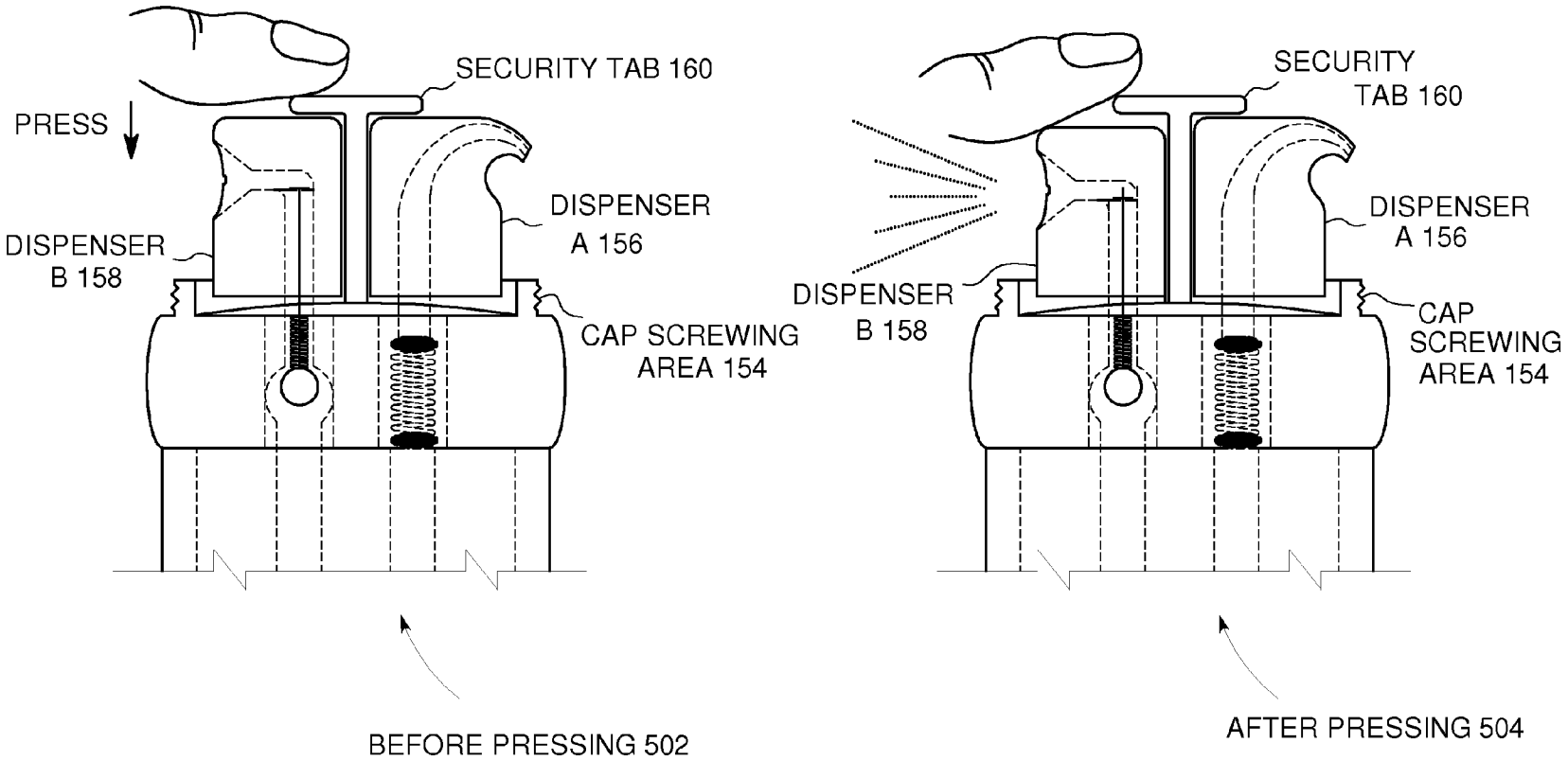
FIG. 5 illustrates the function of a security tab, according to one embodiment.

FIG. 5 illustrates the function of a security tab, according tone embodiment. In an embodiment, 502 illustrate the position of the security tab 160 and the dispenser B 158 before pressing the dispenser tab. In another embodiment, 504 illustrate the position of the security tab 160 and the dispenser B 158 after pressing the dispenser tab. The security tab 160 remains stationary before dispensing and after dispensing the consumable. Only the consumable (e.g., perfume, room freshener, etc) is dispensed from an aperture of the dispenser B 158 and nothing is dispensed from the dispenser A 156. When the dispensing tab is pressed the tab moves down, whereas the security tab 160 remains fixed in its position. The security tab 160 may be hard and inflexible and avoid accidental pressing of both the dispenser tabs simultaneously.

Figure 6A:
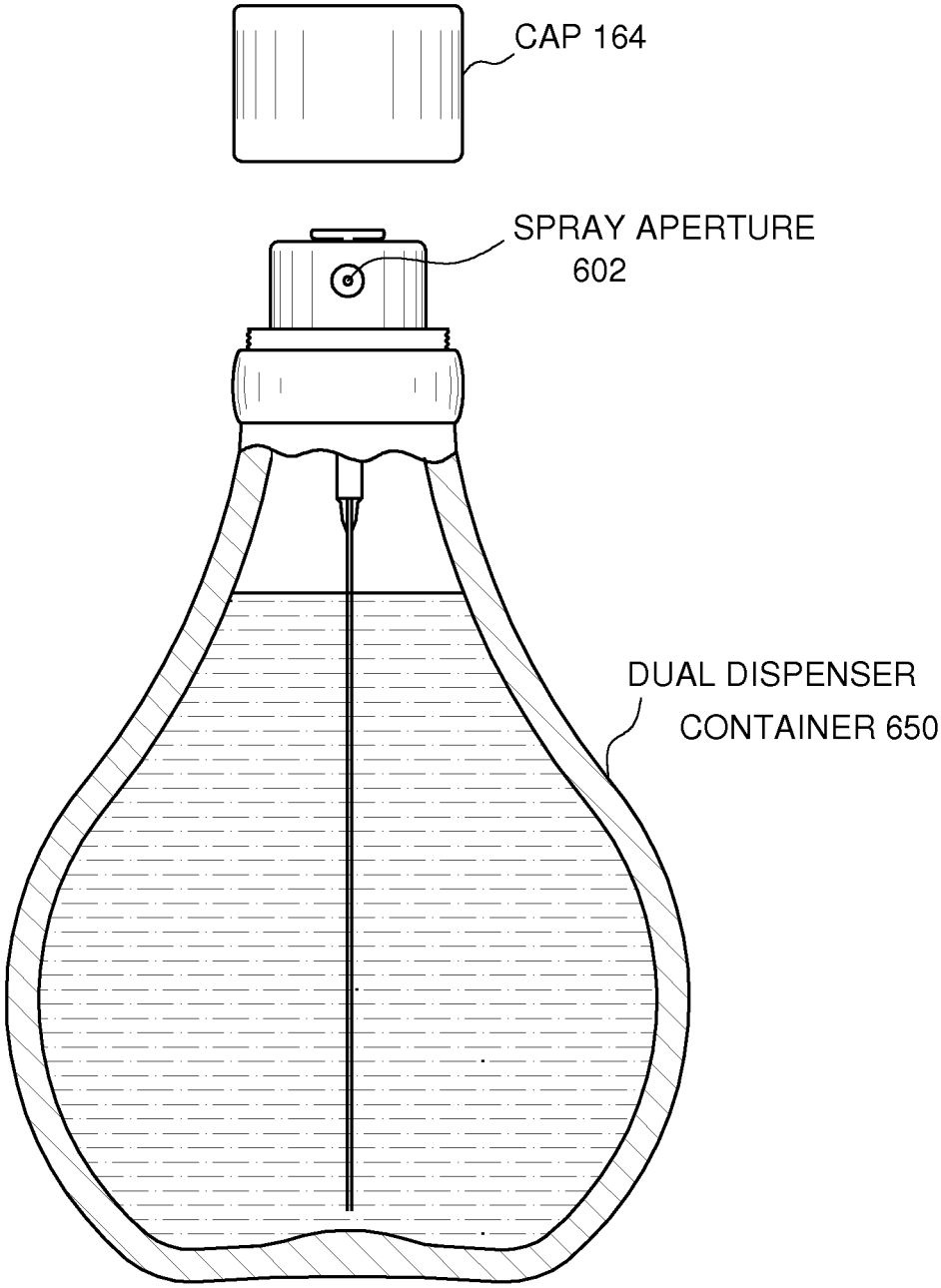
FIG. 6A illustrates a side view of a dual dispenser container with a spray aperture, according to one embodiment.

FIG. 6A illustrates a side view of a dual dispenser container with a spray aperture, according to one embodiment. In one embodiment, FIG. 6A illustrates a dual dispenser container 650 containing two containers filled with consumables as illustrated in FIG. 6A. For example, the containers may be filled with room freshener and insect disinfectant, perfumes, lens cleaning agent etc. Each container may be provided with an aperture (e.g., a spray aperture 602) through which a consumable of the container can be sprayed. The containers may be labeled outside so that a user can distinguish easily and use a suitable consumable. The dual dispenser container 650 may be provided with a cap 654 to avoid accidental spilling of the consumables. The dual dispenser container 650 may be provided with a thick double wall to protect the pouches (e.g., consumable containers) enclosed inside.

Figure 6B:
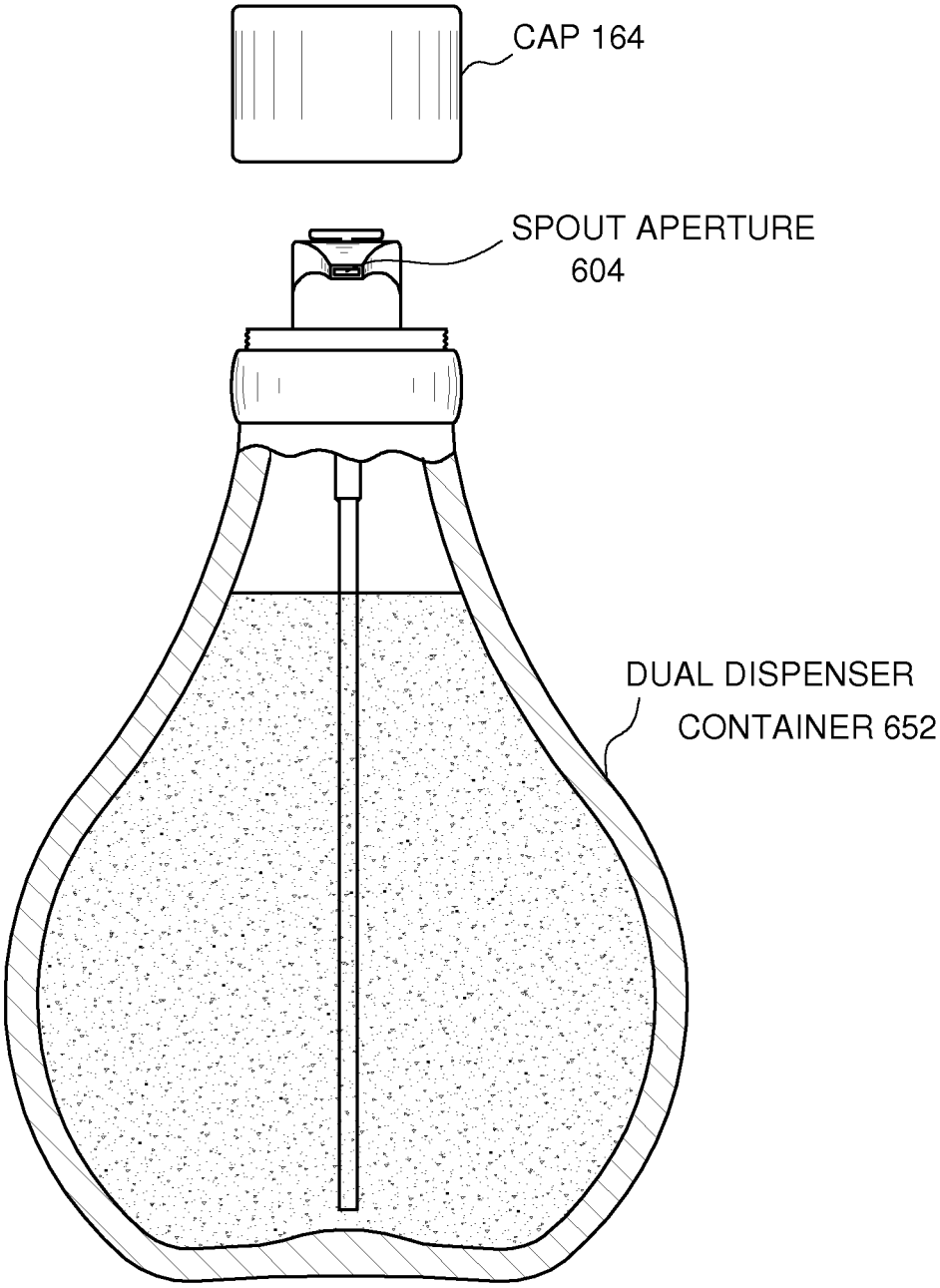
FIG. 6B illustrates a side view of a dual dispenser container with a spout aperture, according to one embodiment.

FIG. 6B illustrates a side view of a dual dispenser 652 container with a spout aperture, according to one embodiment. In particular, FIG. 6A illustrates the dual dispenser container 650 containing two containers filled with consumables as illustrated in FIG. 6B. For example, the containers may be filled with shampoo and conditioner that may be used in one instance. Each container may be provided with an aperture (e.g., a spout aperture 604) through which a consumable of the container can be dispensed. The containers may be labeled outside so that a user can distinguish easily and use a suitable consumable. The dual dispenser container 650 may be provided with a cap 654 to avoid accidental spilling of the consumables.

Figure 7A:
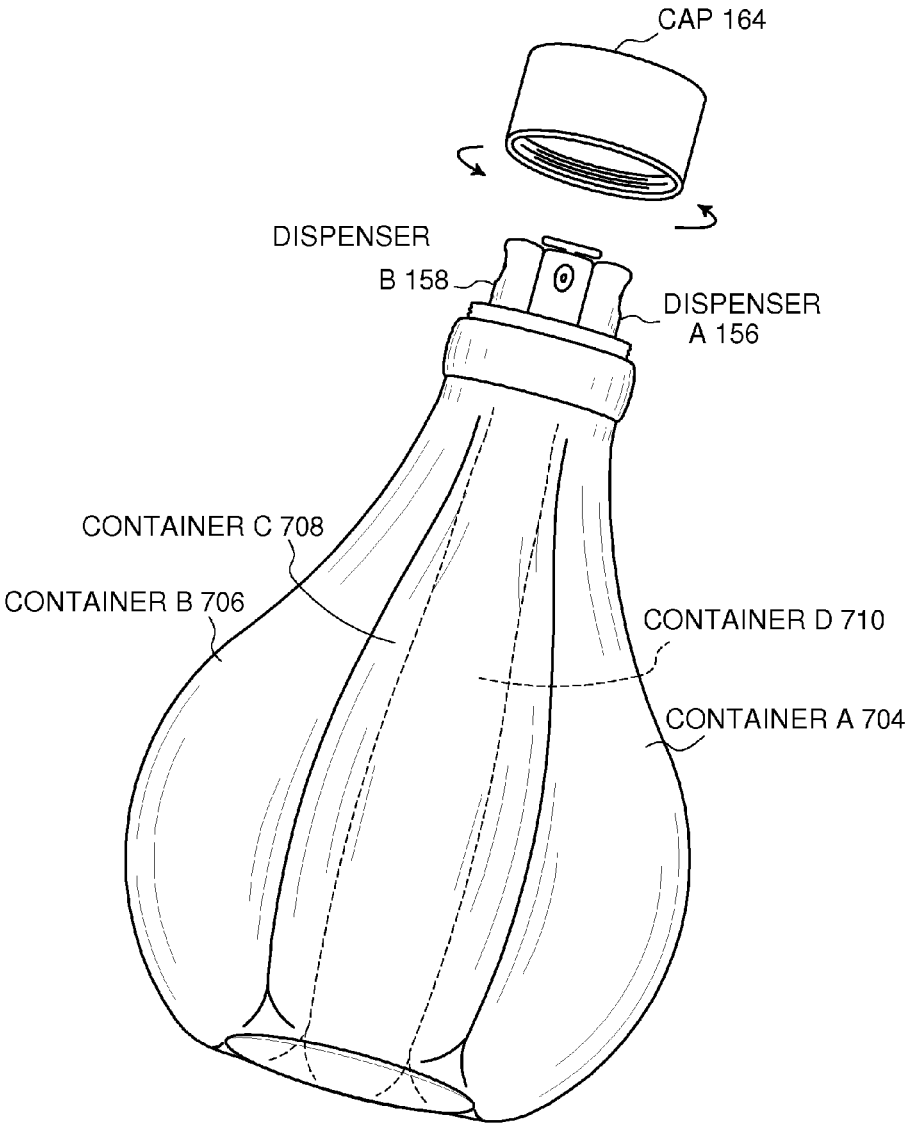
FIG. 7A illustrates a multiple chamber dispenser container, according to one embodiment.

FIG. 7A illustrates a multiple chamber dispenser container, according to one embodiment. The multiple chamber dispenser container may include dual chambers, four chambers and six chambers, a container A 704, a container B 706, a container C 708, and a container D 710 in its chambers. In an example embodiment, the containers 704, 706, 708, and 710 may be used to store consumables that may need to be used consecutively. For example, the multi chambered container may be used to store shower gel, shampoo, conditioner, and/or body lotion. In addition, the containers may also be used to store beverages, chemicals, inks, cosmetics, beverages, medicinal consumables, etc. The containers 704, 706, 708, and 710 may be provided a spout type of dispensers and/or spray type of dispensers depending on the type of the consumable filled in the containers.

Figure 7B:
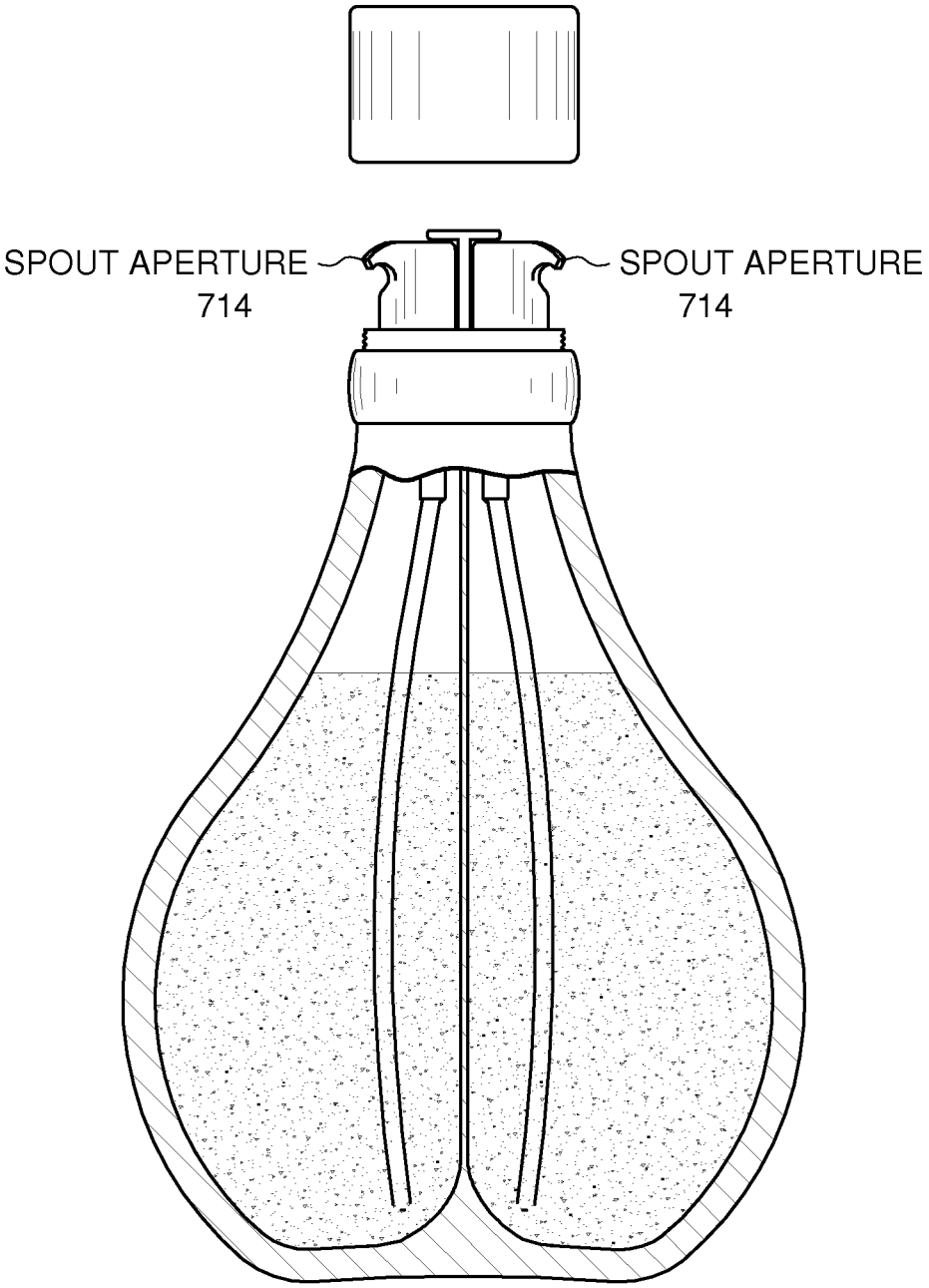
FIG. 7B illustrates a side view of a multiple chamber dispenser container with spout dispensers, according to one embodiment.

FIG. 7B illustrates a side view of a multiple chamber dispenser container with spout dispensers, according to one embodiment. According to one embodiment, the multi chamber dispenser container may provide an option to include multiple spout dispensers, wherein in the cap, the first dispenser, the second dispenser, the container neck, the container are movable parts. Particularly, FIG. 7A illustrates a side view of a multiple chamber dispenser container with spout apertures (e.g., a spout aperture 714).

Figure 7C:
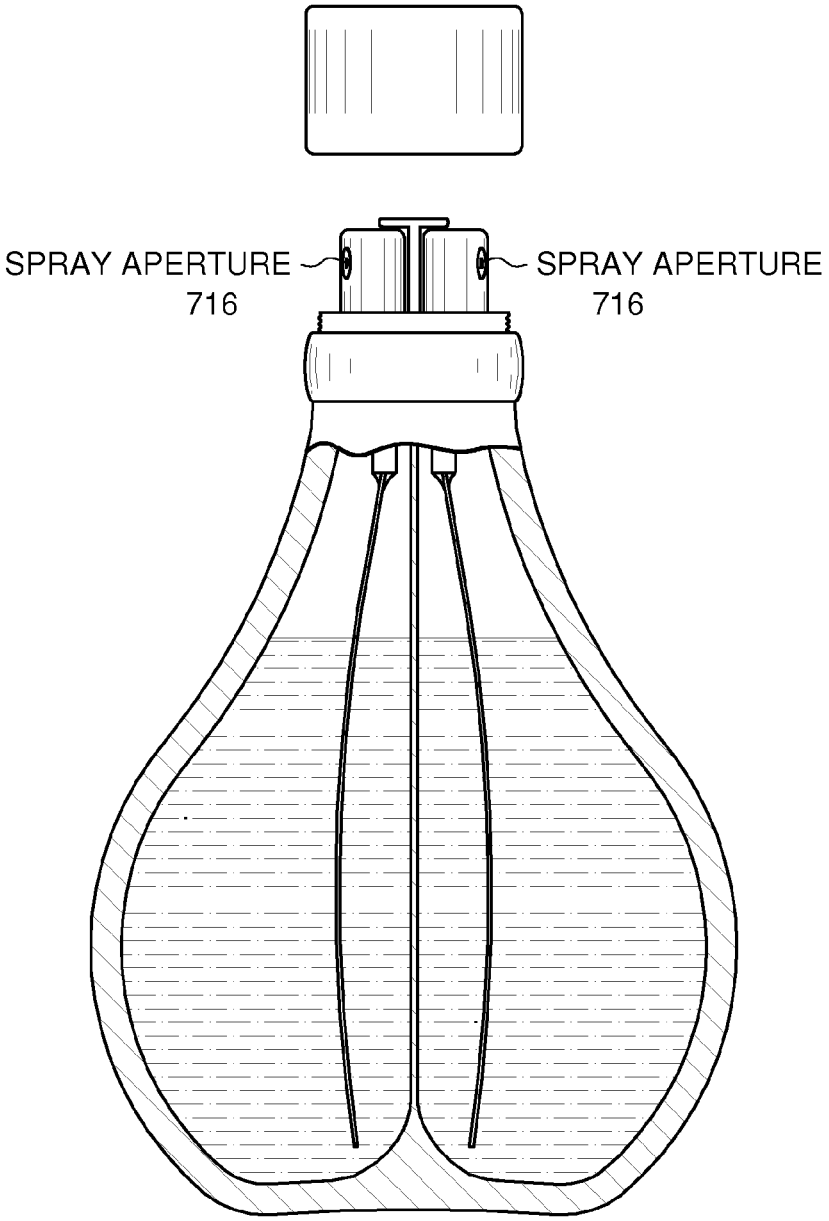
FIG. 7C illustrates a side view of a multiple chamber dispenser container with spray dispensers, according to another embodiment.

FIG. 7C illustrates a side view of a multiple chamber dispenser container with spray dispensers, according to another embodiment. The type of dispenser (e.g., spout and/or spray) may be chosen depending upon the type of consumable to be stored in the containers. In particular, a side view of multiple chamber dispenser containers with spray type of aperture (e.g., a spray aperture 716) is illustrated in FIG. 7C.

Figure 8:
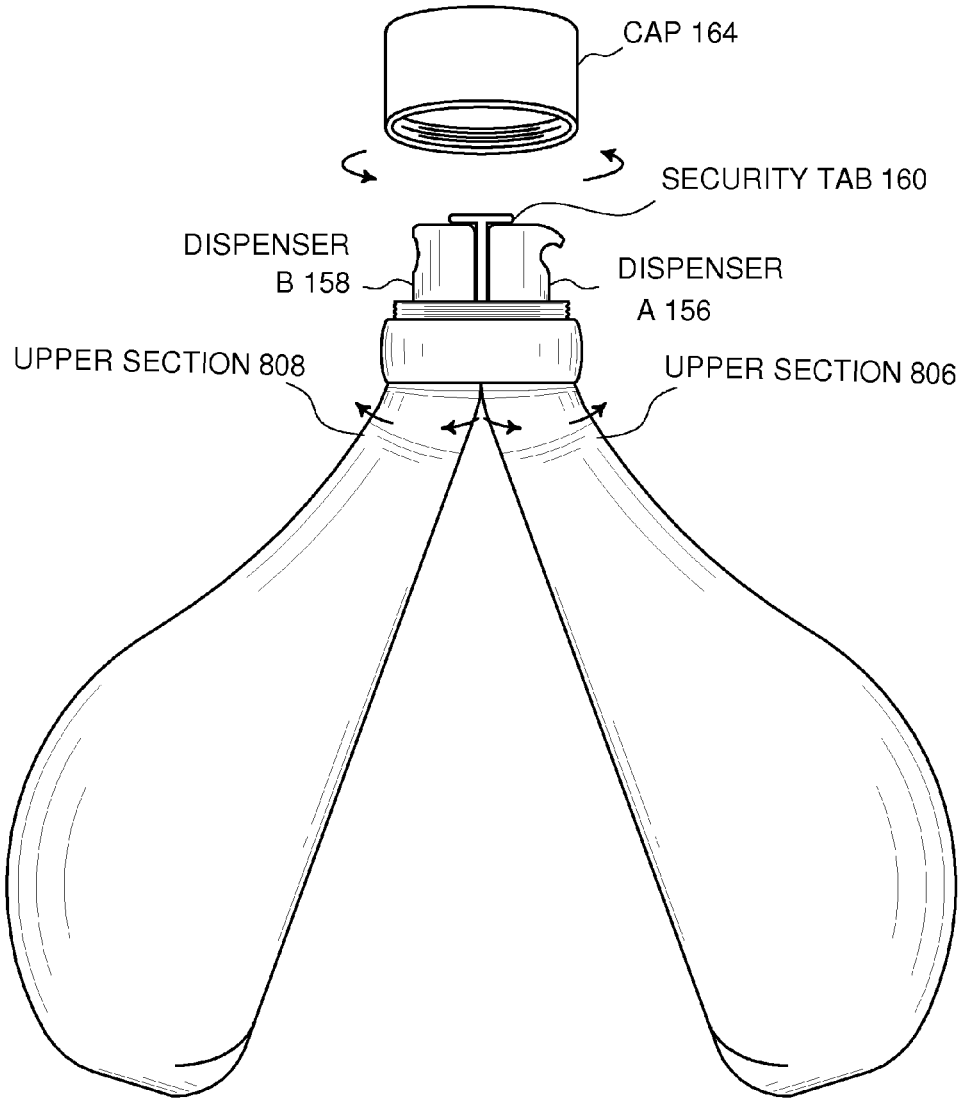
FIG. 8 illustrates assembling of two dispenser container, according to one embodiment.

FIG. 8 illustrates assembling of two dispenser container, according to one embodiment. In an embodiment, an upper section 808 of the dispensing container and an upper section 806 of the other dispensing container may be fitted into the container neck 152 by twisting in the direction of the arrows as illustrated in FIG. 8. The dispenser A 156 and the dispenser B 158 may be fitted to the container neck with the security tab between them. The dispenser A 156 may be a spout dispenser and the dispenser B 158 may be a spray dispenser.

Figure 9A:
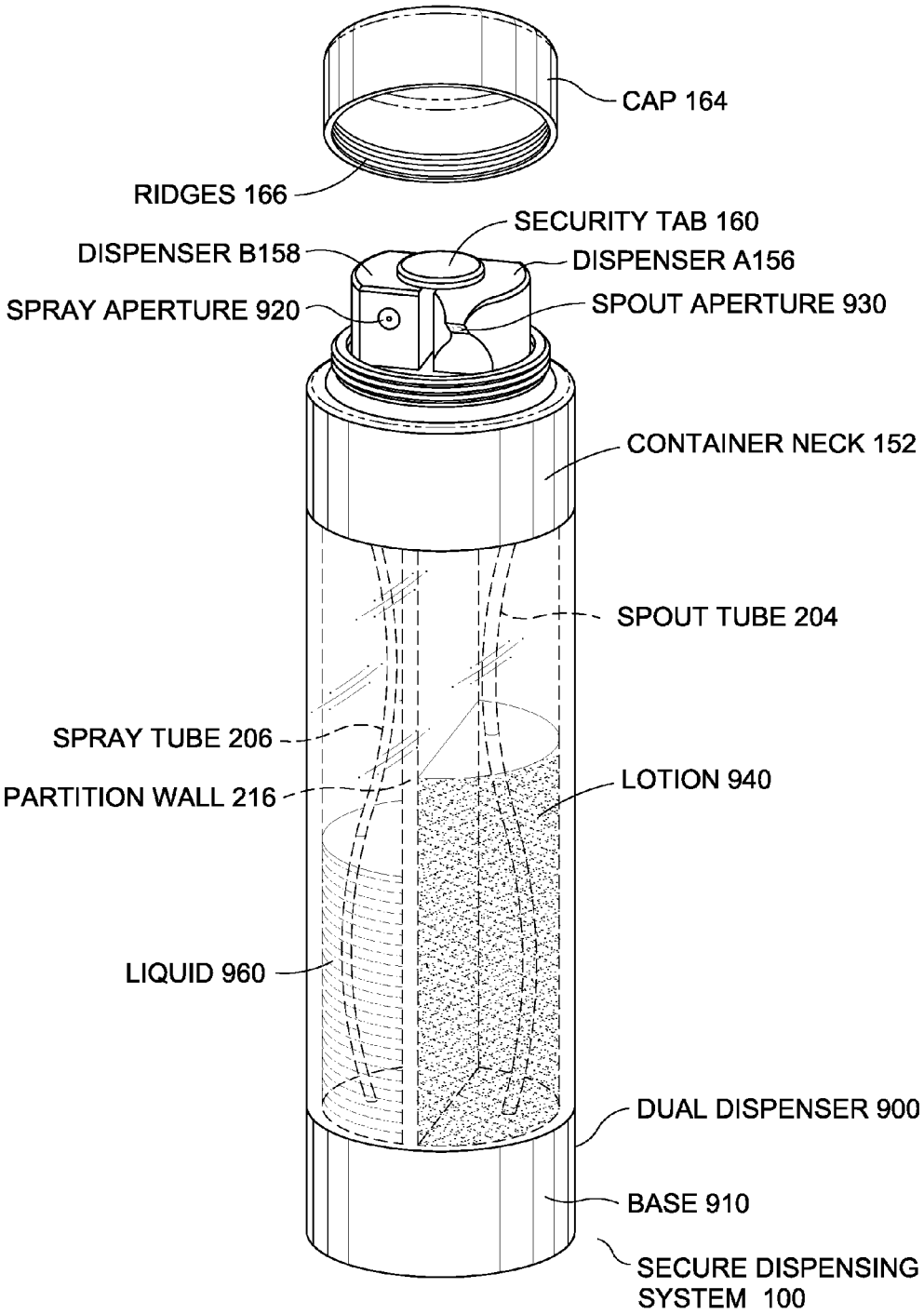
FIG. 9 A illustrates a view of a secure dispensing system with a cylindrical two dispenser container having a spout aperture and spray aperture.
Figure 9B:
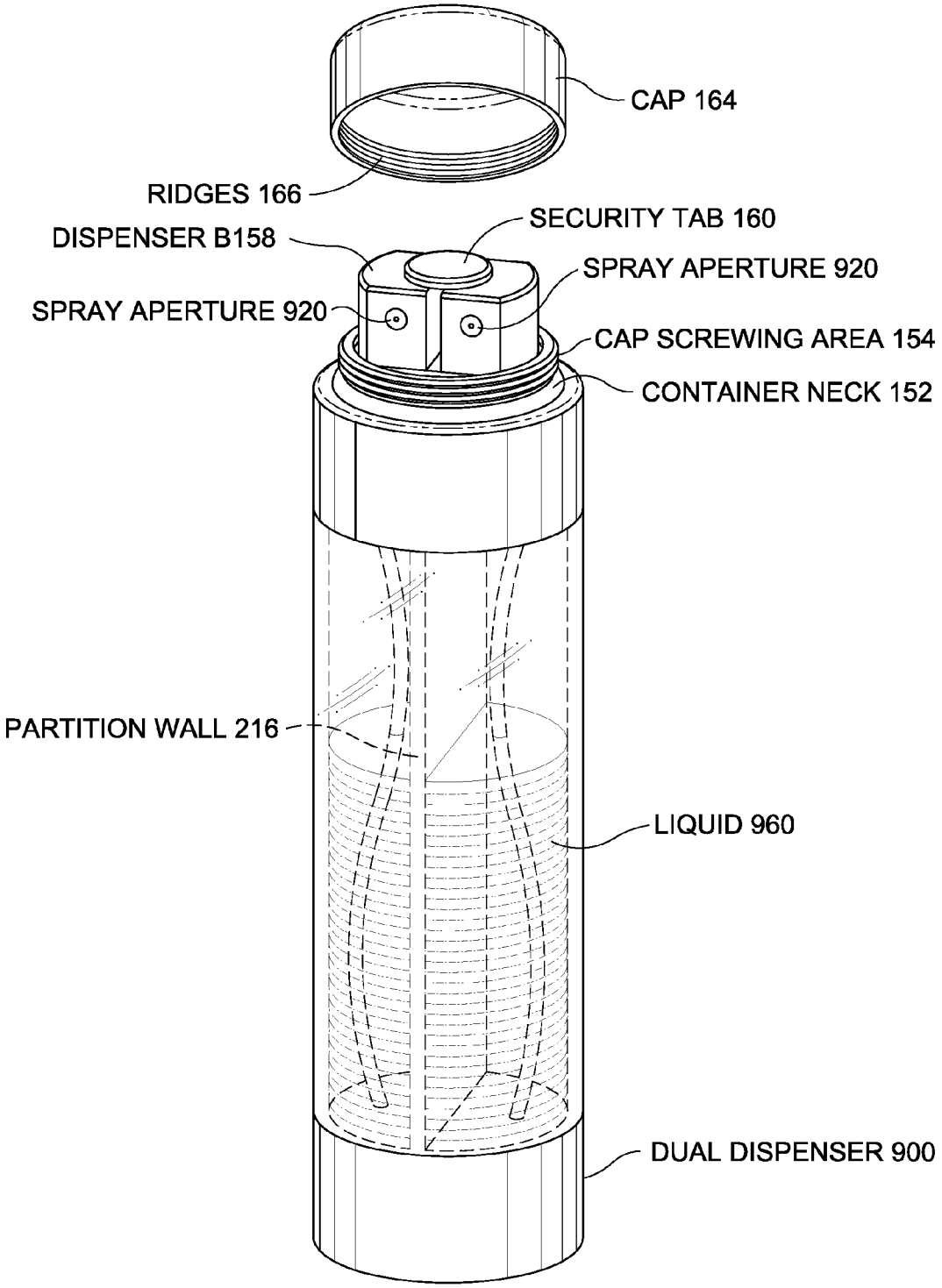

FIG. 9 A illustrates a secure dispensing system 100 containing a cylindrical dual chamber container containing lotion 940 with a spout dispenser 930 and a spray dispenser 920. The security tab 160 is round in shape and spans both of the spout and spray dispensers. The spray and spout dispensers are parallel to each other in this configuration.

FIG. 9 B illustrates a cylindrical dual chamber container enclosed by an outer container with dual spray aperture 920. The entire dual dispenser assembly is externally covered by a round screw on cap 164. The dual dispenser 900 may contain liquid 960 on both sides of the segmented wall or base 910.

Figure 10:
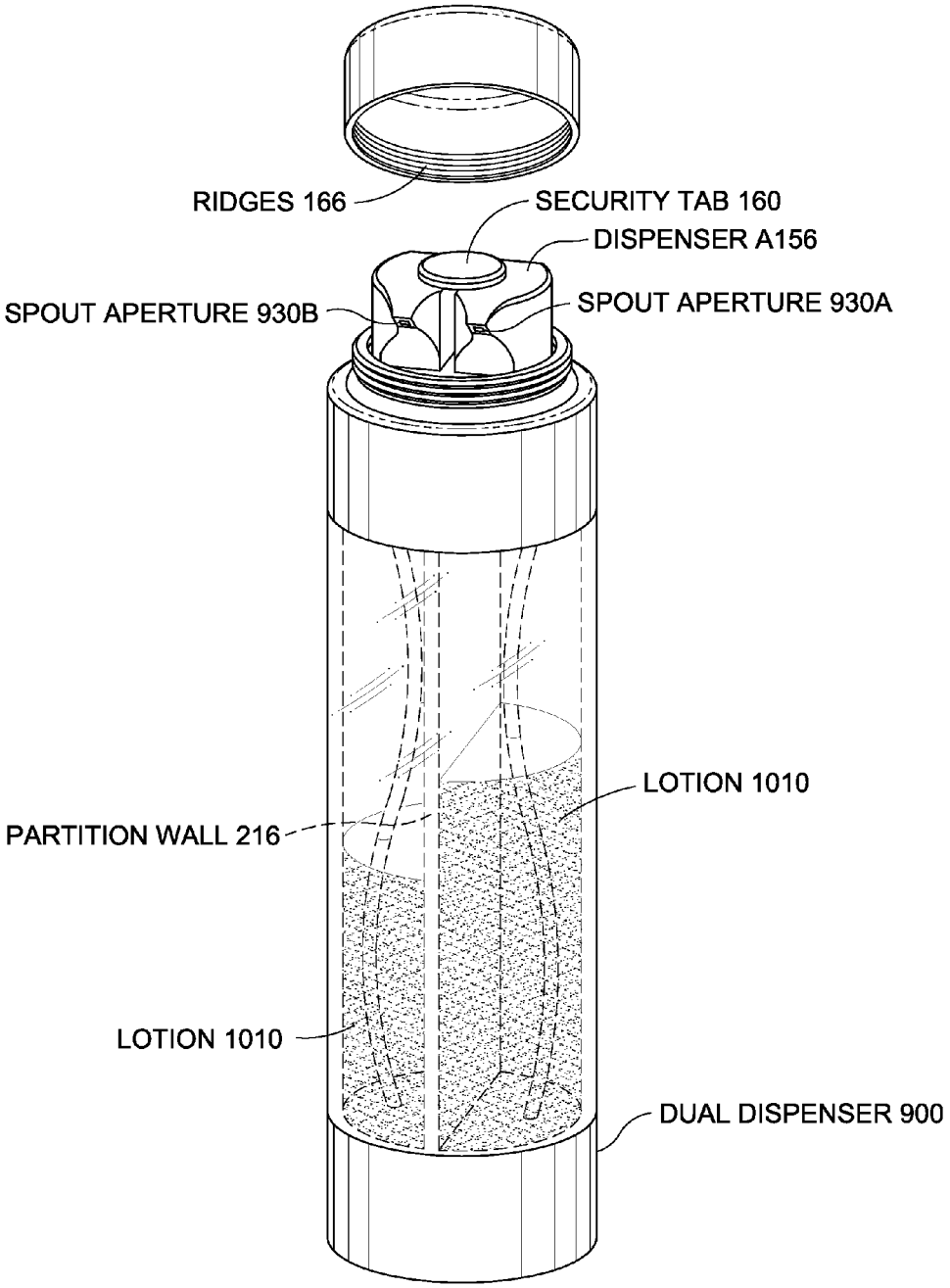
FIG. 10 illustrates a view of a cylindrical two dispenser container with two spout apertures.

FIG. 10 is similar to FIGS. 9 A and 9 B, but has two spout dispensers, spout aperture 930A and spout aperture 930B, as another embodiment. This type of assembly may be used for lotion 1010 dispensing. The figure shows a screw on type of cap 164. In another embodiment it can be a snap shut type of cap as well.

In view of the above, it will be seen that several objects of the invention are achieved and others advantageous results attained. Accordingly, the specification and drawings are to be regarded in an illustrative sense rather than a restrictive sense.

Although the present embodiments have been described with reference to specific example embodiments, it will be evident that various modifications and/or changes may be made to these embodiments without departing from the broader spirit and/or scope of the various embodiments.

What is claimed is:

1. A secure dispensing system, comprising;

a first dispenser and a second dispenser;

a security tab partially covering the first dispenser and the second dispenser, wherein the security tab is placed to prevent fortuitously opening of the first dispenser and the second dispenser together; and a container having a cavity to carry a consumable.

2. The secure dispensing system of claim 1, further comprising;

a spout tube having a first end and a second end, wherein the first end is connected to a spout aperture and the second end is immersed in the cavity.

3. The secure dispensing system of claim 1, further comprising;

a spray tube having a first end and a second end, wherein the first end is connected to a spray aperture and the second end is immersed in the cavity.

4. The secure dispensing system of claim 1, further comprising;

a container neck housing the security tab, wherein the security tab is at least one of screw type, snap on type and moulded with the container neck, wherein the security tab is at least one of round shape, t-shaped or square shaped to partially cover a dispenser.

5. The secure dispensing system of claim 1, wherein the dispenser is at least one of a spout aperture and a spray aperture.

6. The secure dispensing system of claim 5, the placement of the first dispenser and the second dispenser is at least one of 180 degree angle, 90 degree angle, 240 degree angle and parallel to each other.

7. The secure dispensing system of claim 1, wherein the container has at least one of dual chambers, four chambers and six chambers.

8. A secure dispensing system of claim 1, wherein the container is attached to a container neck by at least one of a screw on tab, a snap shut tab and a slide on tab.

9. The secure dispensing system of claim 1, wherein the consumable is at least one of a cosmetic product, a hygienic product, and a medical product.

10. A secure dispenser, comprising;

a first dispenser and a second dispenser;

a security tab partially covering the first dispenser and the second dispenser, wherein the security tab is placed to prevent fortuitously opening of the first dispenser and the second dispenser together;

a container having a cavity to carry a consumable;

a container neck housing the first dispenser, the second dispenser and the security tab; and a cap covering the first dispenser, the second dispenser and the security tab.

11. The secure dispenser as in claim 10, wherein the security tab is at least one of screw type, snap on type and moulded with the container neck, wherein the security tab is at least one of round shape, t-shaped or square shaped to partially cover a dispenser, wherein the security tab is at least one of a screw type, snap on type and mould type, wherein the dispenser is at least one of a spray type and a spout type.

12. The secure dispenser of claim 10, wherein the dispenser is at least one of a spout aperture and a spray aperture.

13. The secure dispenser of claim 11, the placement of the first dispenser and the second dispenser is at least one of 180 degree angle, 90 degree angle, 240 degree angle and parallel to each other.

14. The secure dispenser of claim 10, wherein the container has at least one of dual chambers, four chambers and six chambers.

15. The secure dispenser of claim 10, wherein the consumable is at least one of a cosmetic product, a hygienic product, and a medical product.

16. The secure dispenser of claim 10, wherein the container is made of at least one of glass, thermoplastic material and plastic.

17. The secure dispenser of claim 10, wherein the cap, the first dispenser, the second dispenser, the container neck, the container are movable parts.

18. The secure dispenser of claim 17, wherein the consumable is refillable in the container.

19. A bottle, comprising;

a first container having a first cavity to house a first consumable, a first dispenser associated with the first container, the first dispenser having a spout tube as a inlet and spout aperture as an outlet, a second container having a second cavity to house a second consumable, a second dispenser associated with the second container, the second dispenser having a spray tube as an inlet and spray aperture as an outlet, the first dispenser and the second dispenser separated by a security tab, the security tab partially covers the first dispenser and the second dispenser, the first dispenser, the second dispenser and the security tab house in a container neck, wherein the security tab is placed to prevent fortuitously opening of the first dispenser and the second dispenser together.

20. A bottle as in claim 19, further comprising;

a cap to enclose the first dispenser, the second dispenser and the security tab, wherein the first container and the second container are attached to the to the first dispenser and the second dispenser through the container neck.

* * * * *